United States Patent [19]

Beer

[11] Patent Number: 4,913,561

[45] Date of Patent: Apr. 3, 1990

[54] GUSSETTED FLEXIBLE PACKAGE WITH PRESEALED PORTIONS AND METHOD OF MAKING THE SAME

[75] Inventor: Jeffrey S. Beer, Perkiomenville, Pa.

[73] Assignee: Fres-co System USA, Inc., Telford, Pa.

[21] Appl. No.: 271,973

[22] Filed: Nov. 15, 1988

[51] Int. Cl.[4] ..... B65D 33/00

[52] U.S. Cl. ..... 383/94; 383/120; 383/121; 53/479

[58] Field of Search ..... 383/94, 103, 120, 121, 383/122; 53/479

[56] References Cited

U.S. PATENT DOCUMENTS 4,705,174 11/1987 Goglio ..... 206/632

*Primary Examiner*—Stephen Marcus
*Assistant Examiner*—Jes F. Pascua
*Attorney, Agent, or Firm*—Caesar, Rivise, Bernstein, Cohen & Pokotilow, Ltd.

[57] ABSTRACT

A gussetted flexible tubular package having a longitudinal axis and formed from flexible sheet material, e.g., plastic film. The package comprising a front and rear panel connected by respective side gusset folds. Each of the gusset folds comprises a central fold edge interposed between a pair of outer fold edges and defining therebetween respective gusset sections subadjacent the panels. The upper end of the package has an open mouth defined by upper end portions of the panels located between a pair of side seals. Each of the side seals comprises a longitudinally disposed seal and an angularly diverging seal. The longitudinally located seals each include one portion which seals the panels together contiguous with their respective central fold edges and another portion which seals the panels to their respective subadjacent gusset sections contiguous with the respective central fold edges. Each of the diverging seals seals the panels to their respective subadjacent gusset sections at portions thereof which are located between their respective outer fold edges and their associated longitudinally located seals. The mouth of the package is readily sealable by bringing the upper end portions of the panels between the side seals into contact with each other and applying heat and pressure to those panel portions.

20 Claims, 2 Drawing Sheets

GUSSETTED FLEXIBLE PACKAGE WITH PRESEALED PORTIONS AND METHOD OF MAKING THE SAME

BACKGROUND OF THE INVENTION

This invention relates generally to packaging and more particularly to flexible packaging.

Flexible containers formed of sheet materials have gained wide acceptance in the trade for holding foodstuffs, chemicals, or other air perishable materials therein. One common type of flexible package container is the so-called gussetted package. That package is formed from a web of flexible stock material, e.g., polyethylene, polyester, polypropylene, metal foil, and combinations thereof in single or multiple plies, into a tubular body, having a front panel a rear panel, and a pair of gussetted sides. Each gussetted side is formed by a a pair of gusset sections and a central fold edge interposed between a pair of outer fold edges. The marginal edges of the front and rear panels form the outer fold edges. The outer fold edges of one side of both panels and the interposed central fold edge define therebetween respective gusset sections. Those sections are subadjacent (underlie) the marginal edges of their associated panels. The other gussetted side of the package is constructed in an identical manner. The lower end of many such prior art gussetted packages are commonly permanently sealed, e.g., heat sealed, along a line extending transversely across the width of the package close to the bottom edge of the package. The upper end of each such package is left open to form a mouth for filling (and in many cases, emptying) the package. Thus, it is a common practice to form the mouth of the package of sealable, (e.g., heat sealable), means to enable the package to be sealed at its mouth after the package is filled with its desired contents.

Owing to the fact that the mouth of the package is four layers thick at the marginal edges of the panels (the four layers being the marginal edges of the panels themselves and their respective subadjacent gusset sections), while being only two layers thick between the marginal edges (the two layers being the panels themselves), heat sealing the package's mouth is somewhat difficult to achieve. In particular, one cannot utilize the prior art, continuous sealing technique which is usually employed to seal the mouths of non-gussetted packages. That technique is quite efficient in that it entails moving the packages to be sealed through a sealing station so that the mouth of each package passes between an opposed pair of heated members, e.g., circulating bands, which apply heat and pressure as the packages move thereby. Unfortunately that technique frequently cannot be used to seal gussetted packages due to the inherently long dwell time/pressure necessary for a good seal through the multiple layers of a gussetted package. To obviate that problem it is an accepted technique in the prior art to seal a gussetted package's mouth by the placing of the package in a fixed position between an opposed pair of heated jaws whose length is at least as long as the width of the package to be sealed, and by bringing the jaws towards each other to apply heat and pressure to the interposed portions of the package. In some cases, e.g., depending upon the make-up of the material(s) forming the gussetted package, even that intermittent sealing technique may result in an unevenly sealed or otherwise unacceptably sealed package.

Special means may be provided at the mouth of a gussetted flexible package to facilitates its sealing and easy opening. For example, in U.S. Pat. No. 4,705,174, which is assigned to the same assignee as this invention and whose disclosure is incorporated by reference herein, there is disclosed a gussetted flexible package having a mouth portion including means to enable it to be heat sealed to hermetically hold coffee or some other air perishable material therein, while enabling that package to be readily peeled open at its mouth when it is desire to remove the contents of the package. As disclosed in that patent the mouth of the package is sealed by the use of the aforementioned intermittent sealing technique.

Notwithstanding the teachings of the aforementioned patent, the need still exists for a gussetted flexible package having an open mouth which can be readily sealed, e.g., sealed by the application of heat and pressure to the package's mouth as it is moved past a sealing station.

OBJECTS OF THE INVENTION

Accordingly, it is a general object of this invention to provide flexible packaging which overcomes the disadvantages of the prior art.

It is a further object of this invention to provide a gussetted flexible package having a mouth which can be readily sealed.

It is still a further object of this invention to provide a gussetted flexible package which includes a plurality of presealed portions, as well as an open mouth which can be readily heat sealed after the package is filled.

It is yet a further object of this invention to provide a gussetted flexible package which is simple in construction.

It is yet a further object of tis invention to provide a roll of gussetted flexible packages, each package of which including a open mouth which can be readily heat sealed after the package has been filled.

It is yet another object of this invention to provide a method for making a gussetted package having a readily sealable mouth.

It is still another object of this invention to provide a method of readily sealing the mouth of a gussetted flexible package.

SUMMARY OF THE INVENTION

These and other objects of this invention are achieved by providing a gussetted package having a longitudinal axis and formed from flexible sheet material. The package comprises a pair of panels connected by respective side gusset folds. Each of the gusset folds comprises a central fold edge interposed between a pair of outer fold edges and defining therebetween respective gusset sections which are subadjacent the respective panels. The upper end of the package has an open mouth defined by upper end portions of the panels which are located between a pair of side seals. Each of the side seals comprises a medially located seal and an angularly diverging seal. The medially located seals each include one portion which seals the panels together contiguous with their respective central fold edges and another portion which seals the panels to their respective subadjacent gusset sections contiguous with the respective central fold edges. Each of the diverging seals seals the panels to their respective subadjacent gusset sections at portions thereof which are located between their respective outer fold edges and their associated longitudinally located seals. The mouth of the package is readily sealable by bringing the upper end portions of the panels between the side seals into contact with each other and applying heat and pressure to those panel portions.

The invention also encompasses a method of forming the above described package, and a method of sealing the mouth of that package.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
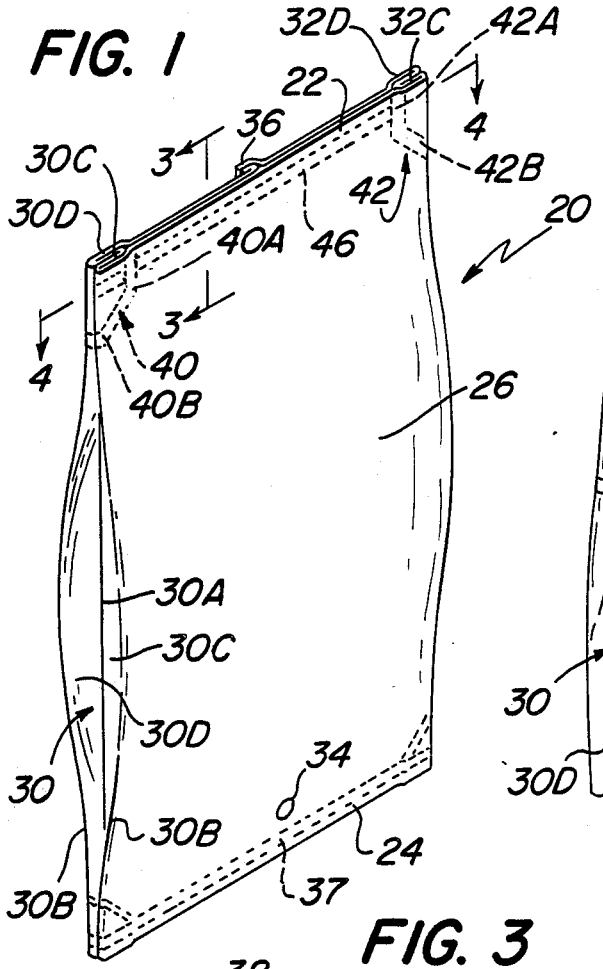
FIG. 1 is an isometric view of one package constructed in accordance with this invention and shown in its condition after its mouth has been sealed to enclose some product or material therein.

Referring now to various figures of the drawing where like reference numerals refer to like parts there is shown at 20 in FIG. 1 one embodiment of the package of the subject invention. The package 20 is fabricated from a long strip of any suitable flexible sheet material, such as those described in the aforenoted patent, which is formed into a tube. The details of the construction of the package 20 and its method of formation will be described later. Suffice it for now to state that the package 20 is of the gussetted type having an upper end 22 including an open mouth (to be described later), and a sealed lower end 24. The package 20 is arranged to be filled with some product or material, e.g., a chemical composition, through its mouth. The mouth is then sealed in accordance with the method of this invention to enclose the contents of the package therein.

It must be pointed out at this time that the single package 20 shown in the drawing is manufactured (fabricated) as one of a large number of serially connected, identical packages. Preferably the serially connected packages are rolled up and stored in a roll (not shown) until they are separated for filling. Thus, the lower end 24 of any one package 20 (except the last) of the roll of plural packages is secured to the upper end 22 of the next succeeding package of the roll by a separation, e.g., perforated, line. Those separation lines are created during the package fabrication process in a conventional manner and thus will not be discussed in detail herein. Suffice it to state that when the packages are separated the separation lines form the upper and lower marginal edges of the package.

The manner in which each of the various permanent seals of package 20 is formed will be discussed further later, as will the method for sealing the mouth of the package shut after it has been filled.

The package 20 basically comprises a front wall or panel 26, a rear wall or panel 28, a first side gusset fold 30, a second side gusset fold 32, the heretofore identified bottom end 22, the heretofore identified upper end 24, and a one-way venting valve 34. The valve enables gases contained within the sealed package 20 to vent to the ambient air without any air gaining ingress to the package's interior.

The front panel 26, rear panel 28, and the two side gusset folds 30 and 32 of the package are all integral portions of a single sheet or web of flexible material which has been folded and seamed to form a tubular body. Thus, the back panel 28 of the package 20 includes a longitudinally extending (vertical) seam 36. The seam is formed by the marginal edges of the sheet or web section which are brought into engagement with each other. Those edges are permanently secured to one another via any conventional sealing technique, such as heat sealing or welding. The lower end 24 of the package is also sealed closed along a permanent seam line 37. That seam line, as well as other seal lines (to be described later) is also formed using conventional sealing techniques, such as those used for seam 36.

Figure 4:
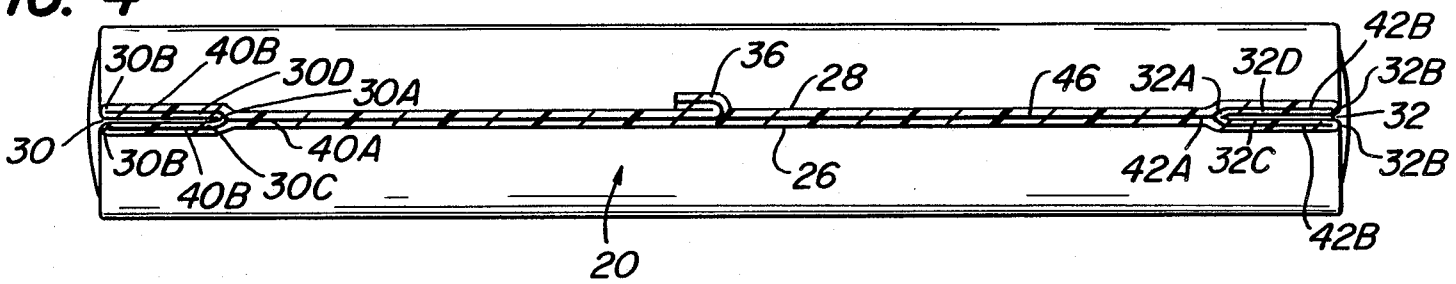
FIG. 4 is an enlarged sectional view taken along line 4—4 of FIG. 1.

The two side gusset folds 30 and 32 are of identical construction. Thus, the same reference letters will be used on the corresponding components forming the gusset folds 30 and 32. To that end, as can be seen clearly in FIGS. 1 and 4 the gusset fold 30 comprises a central fold edge 30A interposed between a pair of outer fold edges 30B. The central fold edges and the outer fold edges all are parallel to the longitudinal axis of the package 20. In a similar manner the gusset fold 32 comprises a central fold edge 32A interposed between a pair of outer fold edges 32B. Two of outer fold edges 30B and 32B form the marginal edges of the front panel 26, while the other two of the outer fold edges 30B and 32B form the marginal edges of the rear panel 28 The pair of outer fold edges 30B define therebetween first and second gusset sections 30C and 30D, respectively. As can be seen the first and second gusset sections 30C and 30D are subadjacent, that is, lie under, the marginal edge portions of the front and rear panels 26 and 28, respectively. Similarly, the first and second gusset sections 32C and 32D are subadjacent the marginal edge portions of the front and rear panels 26 and 28, respectively.

In accordance with the teachings of this invention the upper end 22 of the package 20 includes a mouth portion which is unsealed (i.e., open). That portion is denoted by the reference numeral 38 and is defined between a pair of side seals 40 and 42.

Figure 2:
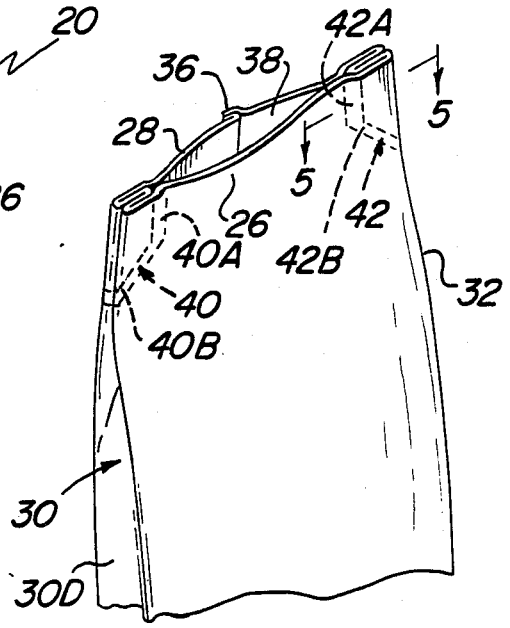
FIG. 2 is an isometric view of the top portion of the package FIG. 1 prior to its mouth being sealed.
Figure 3:
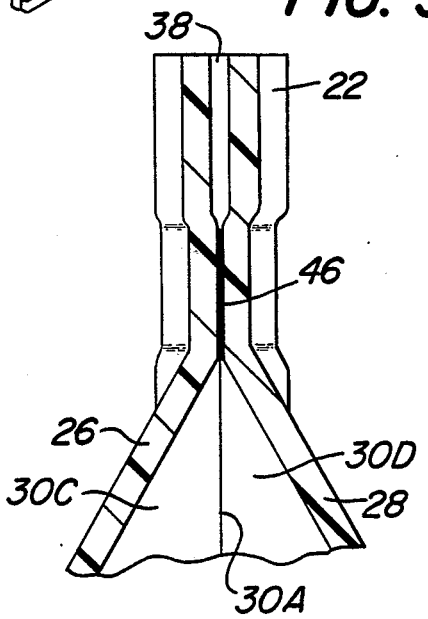
FIG. 3 is an enlarged sectional view taken along line 3—3 of FIG. 1.
Figure 5:
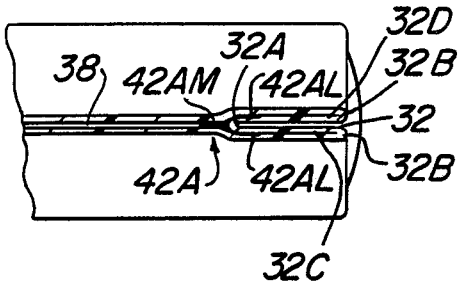
FIG. 5 is an enlarged sectional view taken along line 5—5 of FIG. 2.

The two side seals 40 and 42 are of identical construction. Thus, the same reference letters will be used on the corresponding components forming the side seals 40 and 42. To that end, as can be seen clearly in FIGS. 1 and 2 the side seals 40 and 42 comprise respective medially located, longitudinally oriented, seals 40A and 42A, and respective angularly diverging seals 40B and 42B. As can be seen clearly in FIG. 5 the medially located, longitudinally extending, seal 42A seals (secures) the front and rear panels 26 and 28, respectively, to each other at their opposed portions which are contiguous with the central fold edge 32A on the medial side 42AM of the central fold edge 32A, while also sealing those panels to their respective subadjacent gusset sections 32C and 32D, respectively, which are located on the lateral side 42AL of that central fold edge. The other of the medially located, longitudinally extending seals 40A seals the panels 26 and 28 to each other and to their subadjacent gusset sections 30C and 30D in an identical manner. The diverging seals 42B of the side seals 42 are elongated, generally linear seals which extend at an acute angle to the longitudinal axis of the package so that they diverge from the longitudinally extending seal to the outer fold edges 32B. In particular, the diverging seals 42B seal the front and rear panels 26 and 28, respectively, to their respective subadjacent gusset sections 32C and 32D, respectively, along linear, angularly extending portions thereof which are located between their associated outer fold edges 32B and the medially located, longitudinally extending seal 42A. The diverging seals of the other side seals 40B seal the panels 26 and 28 to their respective subadjacent gusset sections 30C and 30D in an identical manner.

In accordance with a preferred embodiment of this invention the side seals 40 and 42 are formed in the same manner as the lower seal 36 and the longitudinally extending seal 36.

As should thus be appreciated by those skilled in the art the side seals 40 and 42 seal the gusset folds together at the top of the package while sealing the opposed inner surfaces of the front and rear panels together immediately medially of the respective central fold edges 30A and 32A, thereby leaving the virtually all of the medial portion of the inner surfaces of those panels unsecured (open). This creates the heretofore identified mouth 38. Since the mouth only exists between the panels 26 and 28, and not between either of the package's gussets, it is a simple matter to heat seal the mouth via a linear seal 46 after the package is filled. That action may be readily and expeditiously accomplished utilizing any conventional continuous heat sealing apparatus and/or technique(s). Such apparatus is shown at 100 in FIGS. 6 and 7 and is merely exemplary. Other apparatus for sealing packages as they move past a sealing station can be utilized in lieu of the apparatus 100 shown herein. Moreover, if desired, intermittent sealing apparatus, such as the opposed heated jaw devices described heretofore, can be utilized to seal the mouth 38 of the package 20 of this invention.

Figure 7:
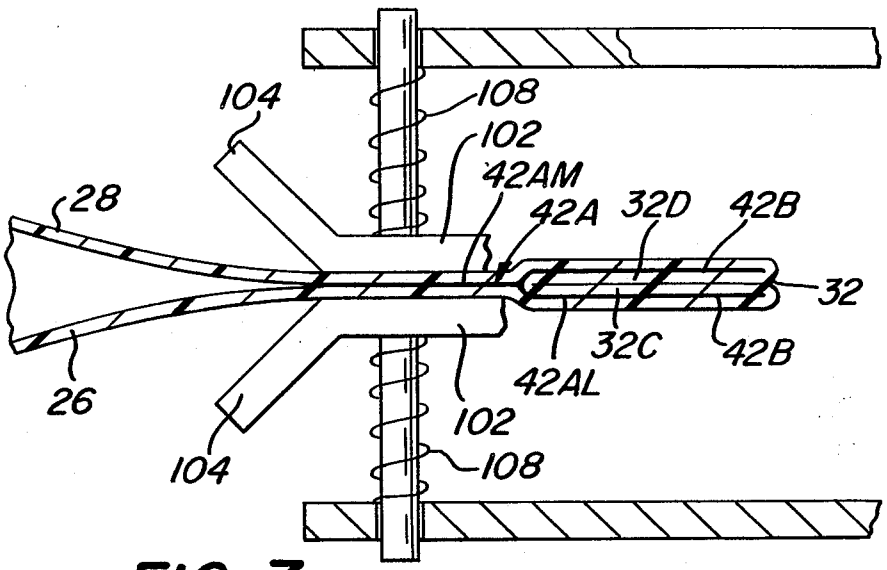
FIG. 7 is an enlarged sectional view, taken along line 7—7 of FIG. 6.
Figure 6:
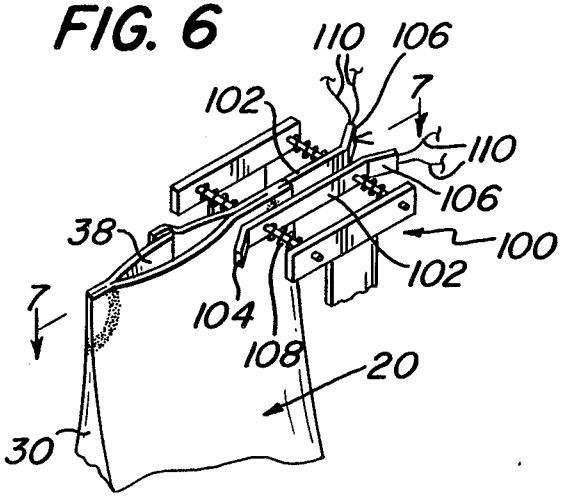
FIG. 6, is a reduced isometric view showing a one portion of process of sealing the mouth of the package shown in FIGS. 1 and 2.

As can be seen in FIGS. 6 and 7 the apparatus 100 comprises an opposed pair of elongated, jaws 102. The leading and trailing ends of the jaws are angled at 104 and 106, respectively. The jaws are mounted horizontally at the appropriate height to form the seal line 46 of the package. The jaws are biased towards each other by associated springs 108 so that the jaws attempt to close the gap between them to a dimension less than the thickness of the two panels 26 and 28 of the package 20. Conventional conveying means (not shown) is provided to carry a plurality of packages 20 which have been filled, but whose mouths 38 are open (unsealed), to the jaws 102. The jaws are electrically heated via conductors 110. Thus, as the leading edge 32 of each package reaches the downstream end of the jaws 102 (as shown in FIGS. 6 and 7) the leading angled ends 104 of the jaws guide the package into the gap between the jaws. Since the leading end of the package is four layers thick (i.e., the front and rear panels 26 and 28, respectively, and subadjacent gusset sections 32C and 32D, respectively) the springs 108 compress to allow the jaws to separate further to take up the increased thickness of that portion of the package. As the package moves further into the jaws they move closer together under the bias force of the springs, whereupon they engage the opposed front and rear panels at the top portions thereof. This action brings the inner surfaces at the mouth of the package into engagement as the packages mouth slides between the jaw, whereupon the heat and pressure applied by the jaws forms the heat seal line 46. As can be seen in FIG. 1 this seal line extends across the full width of the package's mouth. When the trailing end 30 of the package 20 reaches the jaws 20, they separate to allow the package's four layer thickness to pass thereby. This action permits the now sealed package to move away from the jaws. The next package 20 then moves to the jaws for sealing.

Without further elaboration the foregoing will so fully illustrate my invention that others may, by applying current or future knowledge, readily adapt the same for use under various conditions of service.

I claim:

1. A flexible tubular package having a longitudinal axis and formed from flexible sheet material, said package comprising first and second panels disposed opposite each other and connected by respective gusset folds on laterally opposite sides thereof, each of said gusset folds comprising a central fold edge interposed between a pair of outer fold edges and defining therebetween respective gusset sections which are subadjacent said respective panels, said package having an upper end portion comprising an open mouth and a lower end portion which is sealed, said mouth being defined by upper end portions of said panels which are located between first and second side seal means, each of said side seal means comprising a medially located longitudinally extending seal and an angularly diverging seal, one of said medially located seals sealing the panels together at opposed portions thereof which are contiguous with and include the central fold edge on one side of one of said central fold edges while also sealing the panels to their respective subadjacent gusset sections on the opposite side of said one central fold edge and contiguous therewith, the other of said medially located seals sealing the panels together at opposed portions thereof which are contiguous with and include the other of said central fold edges on one side of said other central fold edge while also sealing the two outer panels to their respective subadjacent gusset sections on the opposite side of said other central fold edge and contiguous therewith, the diverging seal of said first side seal means sealing the panels to their respective subadjacent gusset sections at portions thereof which are located between the outer fold edges and the medially located seal of the first seal means, the diverging seal of said second side seal means sealing the panels of their respective subadjacent gusset sections at portions thereof which are located between the outer fold edges and the medially located seal of said second seal means, the mouth of said package being readily sealable by bringing the upper end portions of the panels into contact with each other between said first and second fold seals.

2. The flexible package of claim 1 wherein said upper end portions of said panels between said side seal means are heat sealable.

3. The flexible package of claim 2 wherein said medially located seals and said diverging seals of said side seal means are each formed by heat sealing.

4. The flexible package of claim 3 wherein said lower portion of said package is sealed by a heat seal.

5. The flexible package of claim 4 where said package includes venting valve means.

6. The flexible package of claim 4 wherein said package is part of a roll of similar packages connected to one another via respective separation lines, each of said lines being oriented transversely to said longitudinal axis and located between the upper portion of one package and the lower portion of an immediately preceding package.

7. The flexible package of claim 1 wherein said medially located seal of each of said side seal means is a generally linear seal oriented generally parallel to said longitudinal axis.

8. The flexible package of claim 7 wherein said diverging seal of each of said side seal means merges with the longitudinally oriented medially located seal of its side seal means.

9. The flexible package of claim 8 wherein said medially located seals and said diverging seals of said side seal means are each formed by heat sealing.

10. The flexible package of claim 9 wherein said package is part of a roll of similar packages connected to one another via respective separation lines, each of said lines being oriented transversely to said longitudinal axis and located between the upper portion of one package and the lower portion of an immediately preceding package.

11. The flexible package of claim 9 wherein said material of said package comprises a plastic material.

12. THe flexible package of claim 11 wherein said package is part of a roll of similar packages connected to one another via respective separation lines, each of said lines being oriented transversely to said longitudinal axis and located between the upper portion of one package and the lower portion of an immediately preceding package.

13. The flexible package of claim 12 wherein said package includes venting valve means.

14. The flexible package of claim 1 wherein said package is part of a roll of similar packages connected to one another via respective separation lines, each of said lines being oriented transversely to said longitudinal axis and located between the upper portion of one package and the lower portion of an immediately preceding package.

15. A method of making a readily heat sealable gussetted package comprising the steps of forming a sheet of flexible sheet material into a tubular body comprising a front and rear panel connected by respective side gusset folds, each of said gusset folds comprising a central fold edge interposed between a pair of outer fold edges and defining therebetween respective gusset sections subadjacent said panels, said package having an upper end and a lower end, said upper end including a mouth for said package, said mouth being defined by upper end portions of said panels located between a pair of side seals, heat forming said side seals in said package, each of said side seals comprising a longitudinally disposed seal and an angularly diverging seal extending therefrom, said longitudinally disposed seals each including one portion which seals the panels together contiguous with and including their respective central fold edges and another portion which seals the panels to their respective subadjacent gusset sections contiguous with and including their respective central fold edges, each of said diverging seals sealing the panels to their respective subadjacent gusset sections at portions thereof which are located between their respective outer fold edges and their associated longitudinally located seals, said mouth of said package being readily heat sealable but left unsealed to thereby produce a package which may be thereafter filled and then readily heat sealed at said mouth by the application of heat and pressure thereto.

16. The method of claim 15 wherein said package is formed as one of a plurality of identical packages which are connected to one another and stored in a roll.

17. A method of sealing a gussetted flexible tubular package having a longitudinal axis and formed from flexible sheet material, said package comprising a front and rear panel connected by respective side gusset folds, each of said gusset folds comprises a central fold edge interposed between a pair of outer fold edges and defining therebetween respective gusset sections subadjacent said panels, said package having an upper end including an open mouth defined by upper end portions of said panels located between a pair of side seals, each of said side seals comprising a longitudinally disposed seal and an angularly diverging seal extending therefrom, said longitudinally disposed seals each including one portion which seals the panels together contiguous with and including their respective central fold edges and another portion which seals the panels to their respective subadjacent gusset sections contiguous with and including their respective central fold edges, each of said diverging seals sealing the panels of their respective subadjacent gusset sections at portions thereof which are located between their respective outer fold edges and their associated longitudinally located seals, said mouth of said package being readily heat sealable, said method comprising the steps of bringing the upper end portions of the panels between the side seals into contact with each other and applying heat and pressure to those panel portions to completely seal said package.

18. The method of claim 17 wherein said packages is sealed on a continuous basis by moving it so that its mouth passes between a pair of opposed, heated jaws.

19. The method of claim 17 wherein said package is one of a plurality of identical packages connected to one another and stored in a roll, and method also comprising separating said package from the other packages of said roll prior to sealing.

20. The method of claim 19 wherein said plural packages are sealed on a continuous basis by moving them so that their respective mouths pass between a pair of opposed, heated jaws.

* * * * *